US008727649B2

(12) United States Patent
Inoue

(10) Patent No.: US 8,727,649 B2
(45) Date of Patent: May 20, 2014

(54) ROLL PAPER LOADING MECHANISM AND PRINTING DEVICE

(75) Inventor: Nobuhiro Inoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 479 days.

(21) Appl. No.: 13/095,704

(22) Filed: Apr. 27, 2011

(65) Prior Publication Data

US 2011/0268488 A1 Nov. 3, 2011

(30) Foreign Application Priority Data

Apr. 28, 2010 (JP) ..... 2010-103109

(51) Int. Cl.
*B41J 15/04* (2006.01)
*B41J 29/13* (2006.01)
*B65H 19/12* (2006.01)

(52) U.S. Cl.
USPC ..... 400/613; 400/611; 400/692; 400/693

(58) Field of Classification Search
USPC ..... 400/611, 613, 691, 692, 693
See application file for complete search history.

(56) References Cited

U.S. PATENT DOCUMENTS 5,230,576 A * 7/1993 Sone ..... 400/649
6,474,883 B1 11/2002 Kawakami et al.

FOREIGN PATENT DOCUMENTS

EP 1 086 821 A2 3/2001
JP 05-044944 U 6/1993
JP 2001341903 A * 12/2001
JP 3855591 B2 9/2006

* cited by examiner

*Primary Examiner* — Leslie J Evanisko
(74) *Attorney, Agent, or Firm* — Kilpatrick Townsend & Stockton LLP

(57) ABSTRACT

The roll paper loading mechanism of a roll paper printer has a left side panel rendered in unison with a roll paper holder. The roll paper holder pivots to the front of the printer in conjunction with the operation opening an access cover. When the access cover is opened completely, the left side panel protrudes through an opening formed in the printer case to the front of the printer. A right side panel disposed to hold the roll paper between it and the left side panel is stationary inside the printer case. A roll paper guide tab that projects to the front of the printer and extends away from the left side panel is formed on the front end of the right side panel.

11 Claims, 13 Drawing Sheets

ROLL PAPER LOADING MECHANISM AND PRINTING DEVICE

This application claims priority to Japanese Patent Application No. 2010-103109, filed Apr. 28, 2010, the entirety of which is incorporated by incorporated by reference herein.

BACKGROUND

1. Technical Field

The present invention relates to a printing device that prints on recording paper delivered from a paper roll stored inside, and to a roll paper loading mechanism for loading roll paper into the printing device.

2. Related Art

Printing devices equipped with a roll paper loading mechanism include drop-in type printers that have an opening for loading roll paper rendered in the front of the printer so that the user can tilt an access cover that closes this opening forward and drop the roll paper into the printer.

Japan Patent No. 3855591 teaches a roll paper printer that has this type of roll paper loading mechanism. When the roll paper cover that closes the opening for loading roll paper in this printer is tilted forward, a linkage mechanism that supports the roll paper cover also swings forward. A roll paper loading unit into which the roll paper can be dropped with the rotational axis thereof extending transversely is rendered inside the printer.

The roll paper loading unit in Japan Patent No. 3855591 has a bottom, back, front, and left and right side panels, and the gap between the left and right side walls can be adjusted according to the size of the roll paper. The roll paper loading unit has a roll paper holder that can rotate forward in conjunction with operation of the linkage mechanism when the roll paper cover opens. As a result, when the roll paper cover is opened, one of the side walls and part of the bottom panel of the roll paper loading unit also move forward when the front panel part of the roll paper loading unit rotates to the front. The opening for loading roll paper thus actually becomes larger, and there is no need to lift the roll paper over the front panel part when dropping the roll paper inside. The roll paper can therefore be held substantially level when it is dropped in from the front of the printer. The roll paper loading position also moves forward, making loading the roll paper simple.

Holding the roll paper between and by the left and right side walls of the roll paper loading unit to apply side pressure to the paper roll has also been proposed as a means of preventing the roll paper from rising when recording paper is pulled from the paper roll loaded in the roll paper loading unit.

However, because the gap between the left and right side walls narrows to almost the same width as the roll paper when side pressure is applied to the roll paper by the left and right side walls, the opening to the roll paper loading unit also becomes narrow, making loading the roll paper more difficult. More particularly, when as in the printer described in Japan Patent No. 3855591 one of the side walls does not move from inside the printer, positioning the roll paper widthwise can be difficult when loading the paper, and the paper roll can easily collide with the front edge of the stationary side wall when it is dropped in. This makes pushing the roll paper into the loading position difficult. Furthermore, while the one side wall on the roll paper holder side moves forward with the roll paper cover in the printer taught in Japan Patent No. 3855591, it does not move so far that it is exposed on the outside of the printer case. Positioning to this side wall is therefore also not easy, and the roll paper being loaded can easily collide with the front edge of the side wall.

SUMMARY

A roll paper loading mechanism and a printing device according to the invention enable loading roll paper easily even when the width of the opening to the roll paper loading unit is narrow.

A first aspect of the invention is a roll paper loading mechanism including a linkage mechanism that supports an access cover for opening and closing a roll paper loading opening formed in a device case so that the access cover can pivot on one end and move between a closed position where the opening is closed and an open position to which the other end swings away from the opening; and a roll paper loading unit formed so that when the access cover is open the roll paper can be dropped in with the axis of rotation transverse. The roll paper loading unit includes two side panels disposed to hold the roll paper therebetween in the direction of the axis of rotation when the access cover is closed. One of the two side panels is a movable side panel that can pivot to a position where at least part of the side panel is exposed from the opening outside the device case when the access cover is opened.

When the access cover is opened in this aspect of the invention, the roll paper can be positioned outside the device case to at least one of the side panels of the roll paper loading unit. If the side panel protrudes outside the device case, the operator can easily find the position for aligning the roll paper, and loading failures such as mistakenly setting the roll paper to an edge of the opening or another member inside the opening can be prevented. In addition, because the roll paper can be dropped in along one side panel from outside the device, roll paper can be easily dropped in even if the width of the opening is small. More specifically, roll paper can be easily dropped in even when the width of the roll paper storage space for applying side pressure is narrowed to substantially the same width as the roll paper.

In another aspect of the invention, when the other of the two side panels is a stationary side panel fixed inside the device case, a roll paper guide tab that extends away from the movable side panel as the projection to the side of the opening increases is preferably formed on the end part of the stationary side panel on the opening side.

When such a roll paper guide tab is provided, the roll paper dropped in from a position offset to the outside of the opening from the stationary side panel can be made to hit the inclined face of the roll paper guide tab so that the roll paper moves along the roll paper guide tab to the correct loading position. The roll paper can therefore be easily positioned to the stationary side panel that is not exposed outside the device case, and loading the roll paper is even easier.

Further preferably in another aspect of the invention, the stationary side panel is affixed so that the end part where the roll paper guide tab is formed is a free end that can move toward and away from the movable side panel.

With this aspect of the invention, the link can move by deflecting the stationary side panel even when roll paper guide tab interferes with the path of the link of the linkage mechanism when the access cover opens and closes.

Further preferably in another aspect of the invention, when the linkage mechanism includes a link member disposed along the opposite side of the stationary side panel as the movable side panel, and the link member is configured to descend in the direction in which the access cover pivots when the access cover opens, and overlap the end part of the stationary side panel on the open side, the roll paper guide tab is preferably formed on a part of the stationary side panel separated from the overlap position.

When roll paper is loaded in this aspect of the invention, there is no interference between the link member and the roll paper guide tab, and the stationary side panel does not deflect. The size of the opening from which the roll paper is dropped in therefore does not narrow when the roll paper is loaded.

Further preferably, the part of the roll paper guide tab protruding farthest to the side of the opening is positioned at least the thickness of the stationary side panel from the main part of the stationary side panel in the direction away from the movable side panel.

In this aspect of the invention the distance between the distal end of the roll paper guide tab and the movable side panel is equal to or greater than the distance between the movable side panel and the link member disposed along the opposite side of the stationary side panel as the movable side panel. The roll paper can therefore be positioned to the link member that drops down when the access cover is opened, and if the roll paper is dropped in along the link member, the roll paper strikes the sloped face of the roll paper guide tab and the roll paper is moved by the roll paper guide tab toward the side of the movable side panel. The roll paper can therefore be reliably loaded between the stationary side panel and the movable side panel.

Further preferably, the roll paper loading mechanism also has an urging member that urges the link member to the side of the stationary side panel so that the link member and the stationary side panel touch.

With this aspect of the invention the distal end of the roll paper guide tab can be reliably separated further from the movable side panel than the link member, or positioned the same distance from the movable side panel. Therefore, when roll paper is dropped in along the link member, the roll paper can be reliably shifted by the roll paper guide tab.

In another aspect of the invention, the part of the stationary side panel where the roll paper guide tab is formed deflects in the direction toward the movable side panel due to interference between the roll paper guide tab and the link member when the access cover opens and closes; the movable side panel moves between a first position and a second position on the stationary side panel side of the first position in conjunction with the access cover opening and closing, moves to the first position when the access cover is in the open position, and moves to the second position when the access cover is in the closed position; and the distance between the first position and the second position is preferably greater than or equal to the deflection of the stationary side panel toward the movable side panel caused by interference between the roll paper guide tab and the link member.

When the access cover opens and closes in this aspect of the invention, the width of the opening for dropping in the roll paper will not become narrower than the width of the roll paper storage space when loading is completed because the movable side panel moves in the same direction as the direction in which the stationary side panel deflects when the stationary side panel deflects. As a result, interference with the roll paper when loading the roll paper will not result in such problems as being unable to move the roll paper loading mechanism or load the roll paper.

Further preferably in another aspect of the invention, the link member has a roll guide surface that is opposite the movable side panel and extends straight toward the end part of the stationary side panel, and is formed on a part of the stationary side panel that protrudes from an end part on the open side toward the access cover in the open position.

In this aspect of the invention the roll paper can be guided in a straight line by the link member. In addition, because one end can be guided by the movable side panel and the other end can be guided by the link member, the roll paper does not easily become biased to the loading direction. The roll paper can therefore be prevented from being dropped in at an angle between the stationary side panel and the movable side panel.

Further preferably, a guide boss that protrudes from the roll guide surface toward the movable side panel is disposed to the link member at an intermediate position in the guiding direction of the roll guide surface.

Because the roll paper must ride over the guide boss when such a guide boss is provided, the roll paper will either ride over the guide boss to the stationary side panel side and drop in, or will roll to the front of the guide boss and drop out. The roll paper will therefore not stop at some intermediate position when dropped in.

Further preferably in another aspect of the invention, when the opening is formed in the front of the device case, and the link member moves to the front of the device case and protrudes from the front end of the stationary side panel to the front of the device case when the access cover is opened, the top of the protruding link member is an inclined guide surface that slopes down toward the front of the device case.

When the roll paper cannot be positioned to the inside surface of the link member when it is dropped in and the roll paper falls onto the top of the link member, the roll paper will not drop toward the roll paper storage unit while improperly positioned to the stationary side panel and movable side panel, and will quickly roll toward the front of the device case and fall out. The roll paper will therefore not stop at some intermediate position when dropped in, and can be quickly repositioned and dropped in.

Another aspect of the invention is a printing device including a device case that houses a print mechanism, an opening formed in the device case for loading roll paper, an access cover for opening and closing the opening, and the roll paper loading mechanism described above.

Effect of the Invention

When the access cover is opened in this aspect of the invention, the roll paper can be positioned outside the device case to at least one of the side panels of the roll paper loading unit. If the side panel protrudes outside the device case, the operator can easily find the position for aligning the roll paper, and loading failures such as mistakenly setting the roll paper to an edge of the opening or another member inside the opening can be prevented. In addition, because the roll paper can be dropped in along one side panel from outside the device, roll paper can be easily dropped in even if the width of the opening is small. More specifically, roll paper can be easily dropped in even when the width of the roll paper storage space for applying side pressure is narrowed to substantially the same width as the roll paper.

Other objects and attainments together with a fuller understanding of the invention will become apparent and appreciated by referring to the following description and claims taken in conjunction with the accompanying drawings.

DESCRIPTION OF EMBODIMENTS

A roll paper printer is described below as a preferred embodiment of a printing device according to the invention with reference to the accompanying figures.

General Configuration

Figure 1:
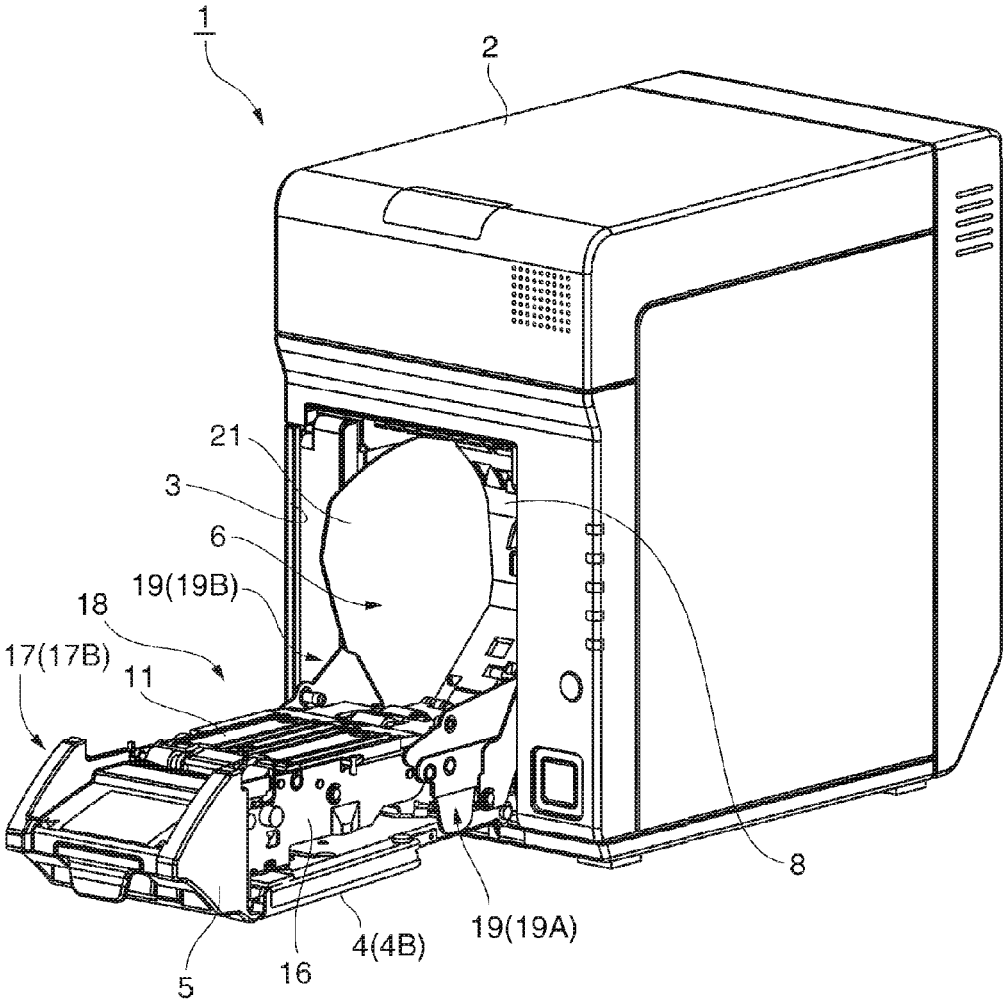
FIG. 1 is an external oblique view from the right front side of roll paper printer according to a preferred embodiment of the invention when the access cover is open.
Figure 2:
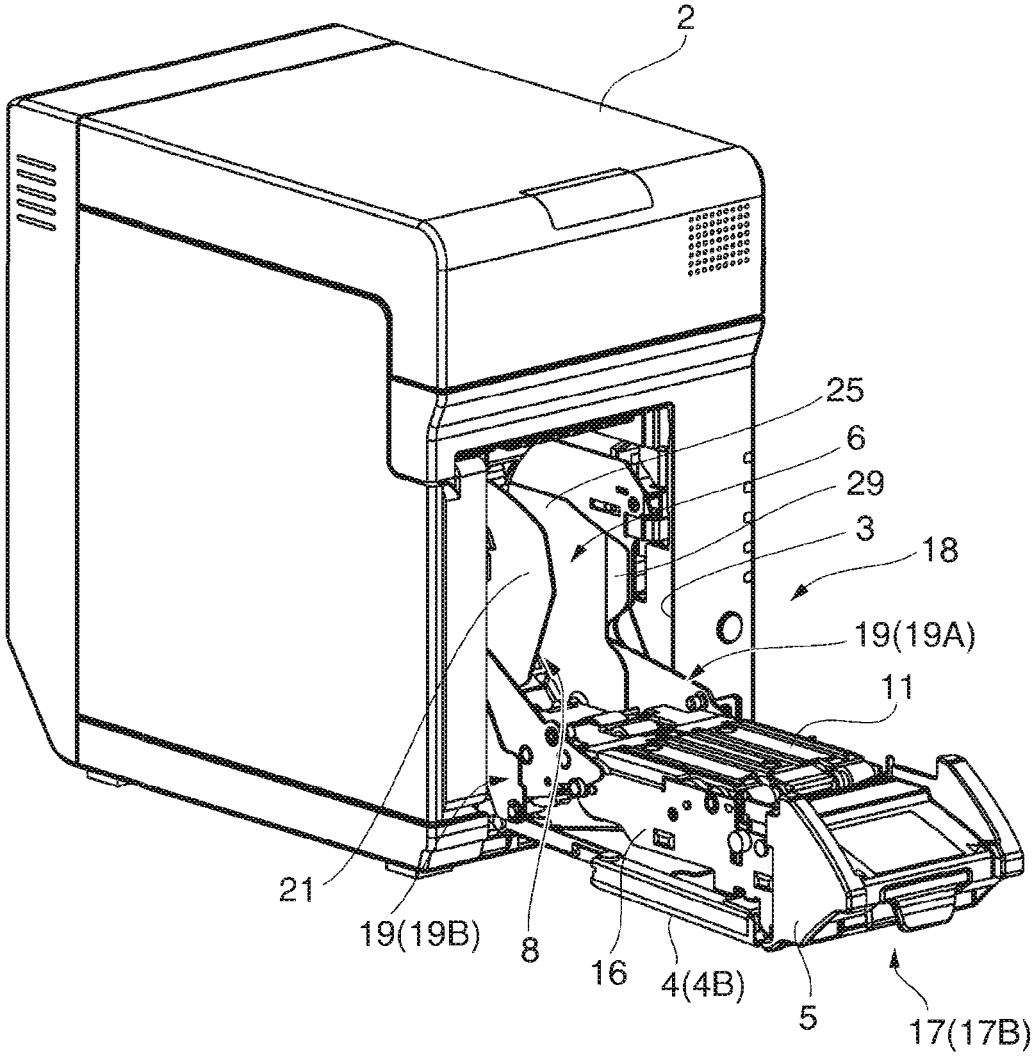
FIG. 2 is an external oblique view from the left front side of a roll paper printer according to a preferred embodiment of the invention when the access cover is open.

FIG. 1 and FIG. 2 are external oblique views of a roll paper printer according to this embodiment of the invention when the access cover is open, FIG. 1 being an external view from the right front side and FIG. 2 being an external view from the front left side. The roll paper printer 1 (printing device) prints on a web of recording paper delivered from a paper roll, and has a printer case 2 (device case) that is generally box-shaped. An opening 3 for loading roll paper is formed in the front middle part of the printer case 2. An access cover 4 (opening/closing cover) is attached to the opening 3, and a roll paper exit guide 5 is disposed at the top of the access cover 4.

Figure 3:
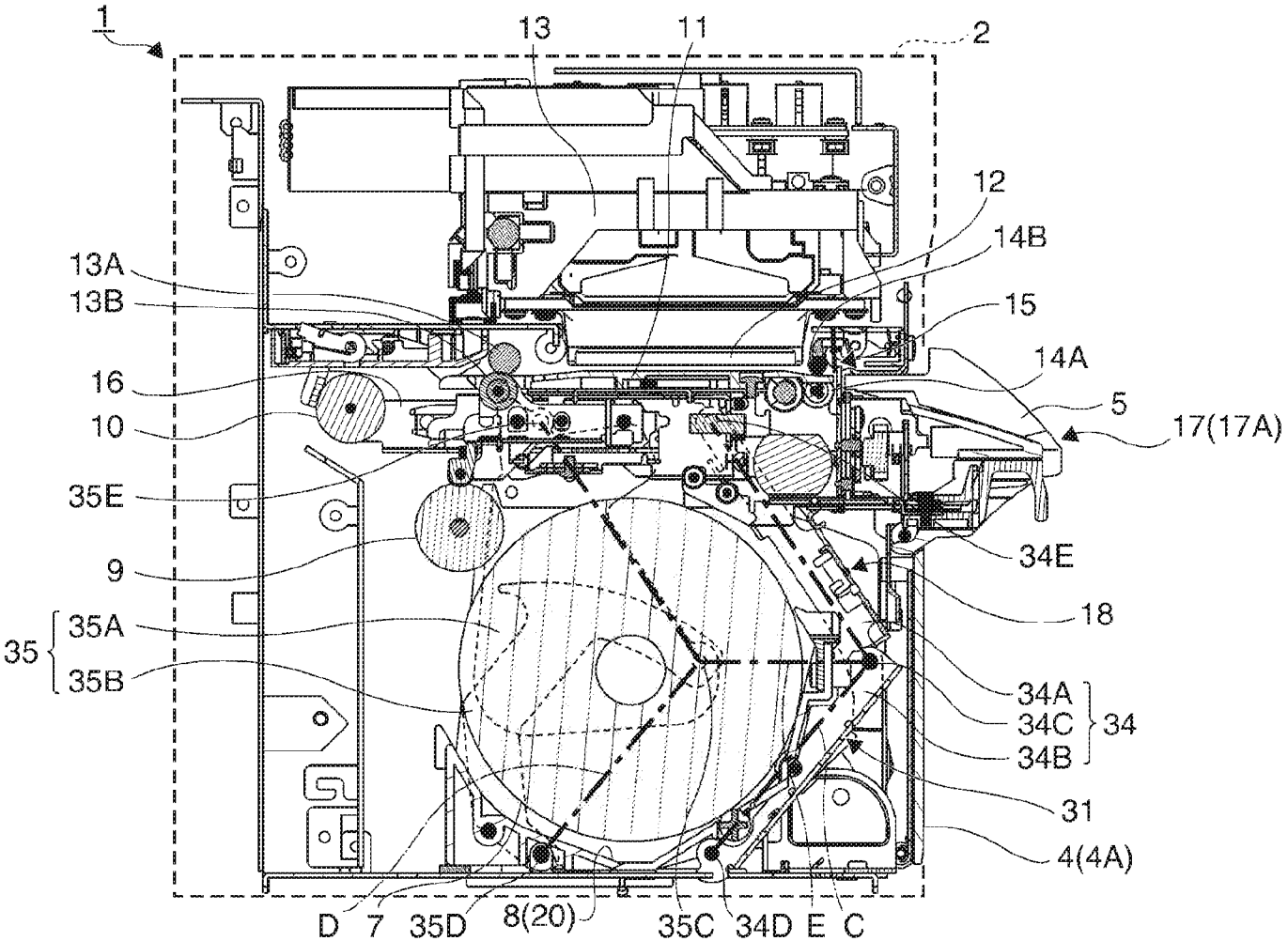
FIG. 3 is a section view of the roll paper cover when the access cover is closed.
Figure 4:
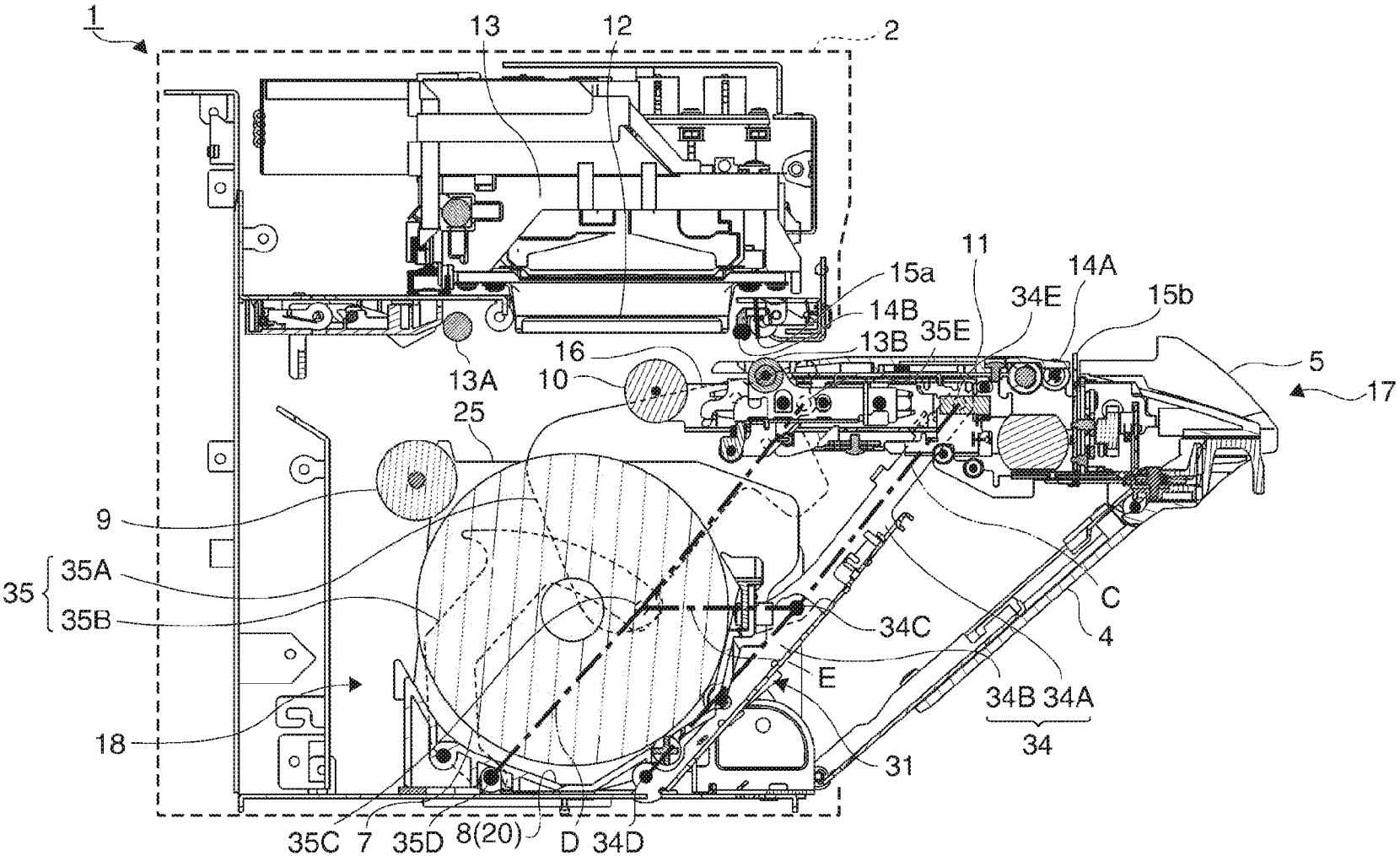
FIG. 4 is a section view of the roll paper cover when the access cover is partially open.
Figure 5:
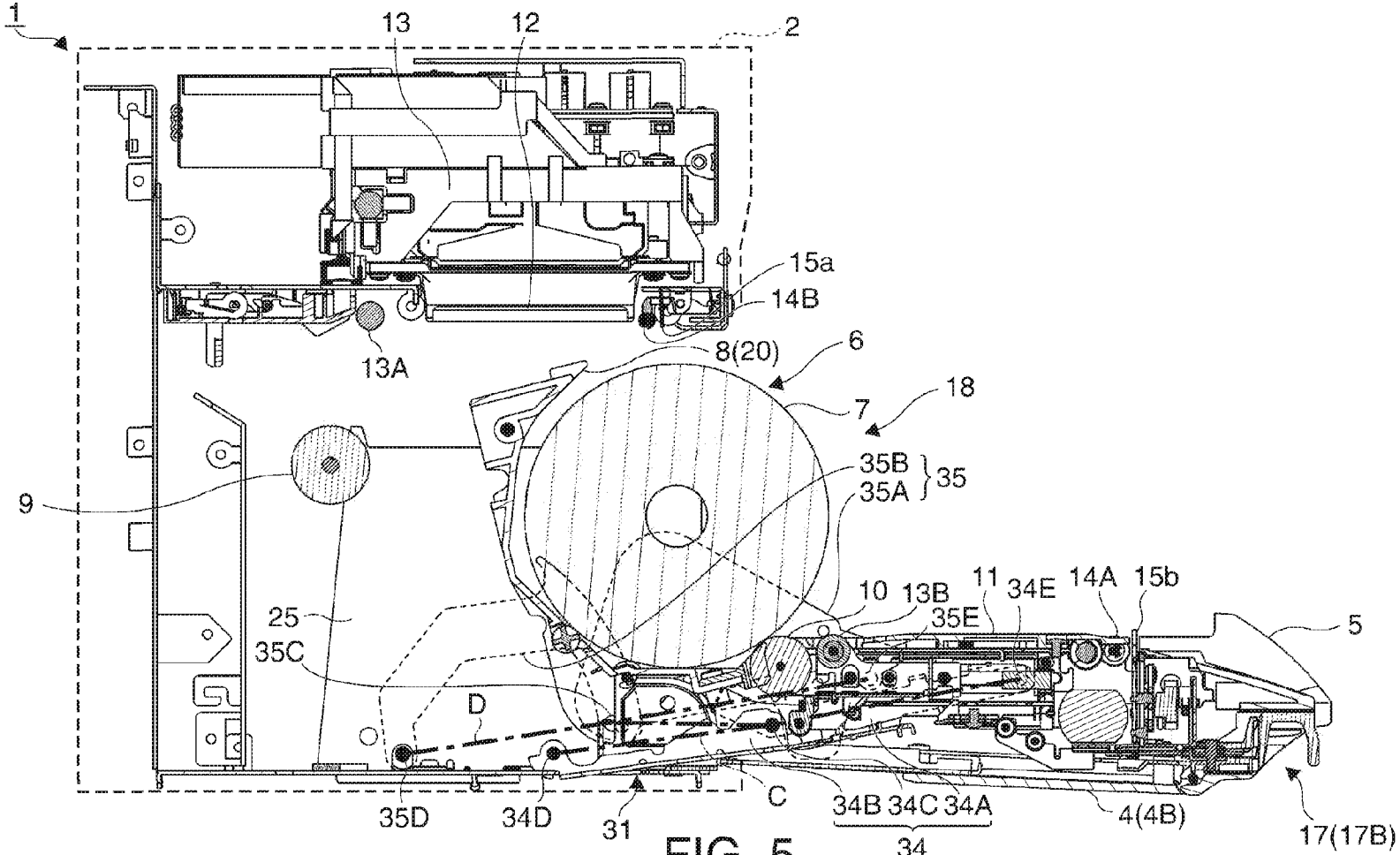
FIG. 5 is a section view of the roll paper cover when the access cover is open.

FIG. 3 to FIG. 5 are section views of the roll paper printer, FIG. 3 showing the access cover 4 in the closed position, FIG. 4 showing the cover partially open, and FIG. 5 showing the cover opened to the maximum opening. When the access cover 4 is closed as shown in FIG. 3, a recording paper exit is formed between the roll paper exit guide 5 and the top edge of the opening 3 in the printer case 2. The access cover 4 can be pivoted forward on the bottom end thereof and opened from the closed position 4A where it is upright at the front of the printer case 2 as shown in FIG. 3 to the open position 4B shown in FIG. 5. When the access cover 4 is open, roll paper 7 can be dropped into the roll paper compartment 6 with the rotational axis of the roll paper 7 transverse.

A roll paper holder 8 that is curved when seen from the side and opens to the top is disposed in the roll paper compartment 6, and the roll paper 7 is stored therein so that it can rotate on the roll paper holder 8. The detailed configuration of the roll paper compartment 6 is described below.

The roll paper 7 stored in the roll paper compartment 6 is delivered by a supply roller 9 from a point on the roll paper 7 at the back side of the printer. The web of recording paper supplied by the supply roller 9 travels around a tension roller 10 located above and to the back of the printer relative to the supply roller 9, passes over the surface of the platen 11 located directly above the roll paper compartment 6, and is conveyed from the back of the printer to the front of the printer.

A head carriage 13 on which the printhead 12 is mounted is disposed movably bidirectionally widthwise to the printer on a carriage guide shaft directly above the platen 11. The printhead 12 is an inkjet head, and the nozzle surface is opposite the top of the platen 11 with a constant gap therebetween. A paper feed drive roller 13A is disposed behind the platen 11, and a paper feed follower 13B is pressed from below to the paper feed drive roller 13A. A discharge drive roller 14A is disposed in front of the platen 11, and a discharge follower roller 14B is pressed from above to the discharge drive roller 14A.

The recording paper is conveyed passed the printing position defined on the top of the platen 11 toward the recording paper exit. The printhead 12 prints on the surface of the recording paper passing the printing position. The recording paper discharged by the discharge drive roller 14A and discharge follower roller 14B is cut widthwise by the fixed knife 15*a* and movable knife 15*b* of the paper cutter mechanism 15, which is located near the paper exit. The piece of recording paper (not shown in the figure) that is thus cut to a certain length may be issued as a receipt, for example.

As shown in FIG. 3 to FIG. 5, the platen 11, paper feed follower 13B, discharge drive roller 14A, and the movable knife 15*b* and drive mechanism of the paper cutter mechanism 15 are mounted on the platen frame 16 and move in unison as a platen unit 17. The tension roller 10 is disposed at the back end of the platen unit 17, and the roll paper exit guide 5 is attached to the front end. The access cover 4 is linked to the platen unit 17. When the access cover 4 is closed, the platen unit 17 is in the closed position 17A (the position shown in FIG. 3) where the platen 11 determines the printing position of the printhead 12. When the access cover 4 is open, the platen unit 17 is in the open position 17B shown in FIG. 5, and the paper feed path from the roll paper compartment 6 to the paper exit is open.

The access cover 4 is thus connected to the platen unit 17, and when the platen unit 17 is pulled forward the access cover 4 pivots on its bottom end and opens to the front. The roll paper holder 8 of the roll paper compartment 6 in this embodiment of the invention also rotates to a position tilted a specific angle towards the front of the printer as shown in FIG. 5.

Roll Paper Loading Mechanism

The roll paper loading mechanism 18 includes a platen support mechanism 19 that supports the platen unit 17 movably from the closed position 17A to the open position 17B, and supports the access cover 4 movably from the closed position 4A to the open position 4B. The platen support mechanism 19 includes a right platen support mechanism 19A disposed on the side on the right side of the roll paper printer 1 (see FIG. 1 and FIG. 2), and a left platen support mechanism 19B that is supported on the side on the left side of the printer (see FIG. 1 and FIG. 2). The left platen support mechanism 19B is left-right symmetrical (plane symmetrical) to the right platen support mechanism 19A, and the basic configurations thereof are the same. The roll paper loading mechanism 18 also includes the roll paper compartment 6 with the roll paper holder 8 described above.

Roll Paper Storage Unit

Figure 6:
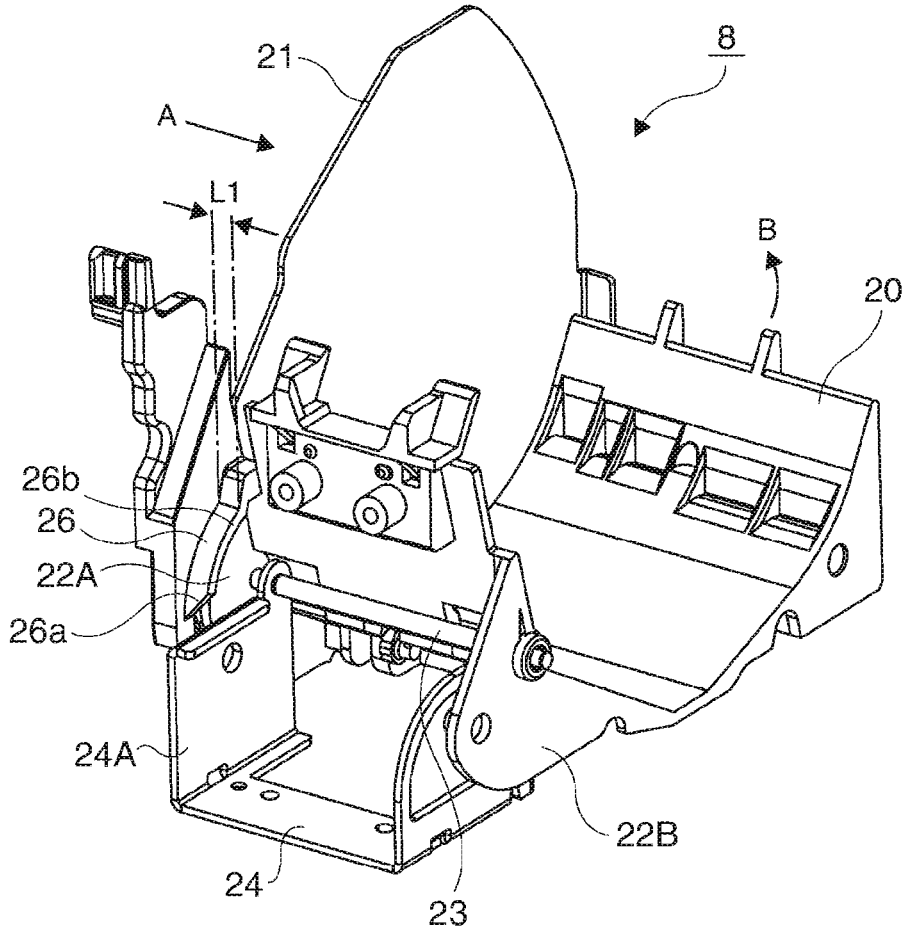
FIG. 6 is an oblique view from the front right side of the roll paper holder and support mechanism.

FIG. 6 is an oblique view of the roll paper holder and support mechanism from the right front side. The roll paper holder 8 includes a bottom 20 that is curved when seen from the side, and a left side panel 21 (movable side panel) that is disposed to a position facing the left end of the roll paper 7 resting on the bottom 20. The left side panel 21 is rendered in unison with the bottom 20. A left connection plate 22A and a right connection plate 22B that extend diagonally downward to the front are formed at the left and right side front edges of the bottom 20. A support shaft 23 is attached transversely between these connection plates. The support shaft 23 spans a support bracket 24, which is fixed to the bottom 28 (see FIG. 7) of the main printer frame. As a result, the roll paper holder 8 can pivot on the support shaft 23.

The roll paper compartment 6 has a right side panel 25 (stationary side panel, see FIG. 2) disposed opposing the right end of the roll paper 7 placed on the bottom 20. The right side panel 25 is formed independently of the roll paper holder 8, and is attached to the inside of the printer case 2. The configuration of the right side panel 25 is described in detail below. The left side panel 21 and right side panel 25 are shaped so that they cover all of the left end and right end of the roll paper 7 placed on the bottom 20.

The roll paper holder 8 is urged to the right side (in the direction of arrow A in FIG. 6) by an urging member such as a compression spring not shown that is disposed on the left side of the left side panel 21, that is, on the outside of the roll paper holder 8. When positioned as seen in FIG. 6 (the position in which the roll paper holder 8 is not pivoted to the front of the printer, that is, when the access cover 4 is closed), the roll paper holder 8 is moved to the right by this urging force until the left connection plate 22A of the roll paper holder 8 contacts the left support panel 24A of the support bracket 24. In this position the gap between the left side panel 21 and right side panel 25 is smallest, the left side panel 21 and right side panel 25 are touching the left end and right end of the roll paper 7, and side pressure is applied to the roll paper 7.

When the access cover 4 opens, the roll paper holder 8 pivots toward the front of the printer (in the direction of arrow B in FIG. 6). At this time the tapered surface 26*a* formed on one end of a side pressure release cam 26, which protrudes to the right from the left connection plate 22A of the roll paper holder 8, contacts the left support panel 24A of the support bracket 24. When the roll paper holder 8 pivots further to the front, the point of contact between the side pressure release cam 26 and the left support panel 24A moves along the tapered surface 26*a*, the roll paper holder 8 therefore moves to the left in opposition to the urging force, and the left side panel 21 gradually moves away from the right side panel 25. When the contact point between the side pressure release cam 26 and left support panel 24A moves passed the tapered surface 26*a*, the left support panel 24A contacts the flat surface 26*b* of the side pressure release cam 26 at a position a specific distance from the left connection plate 22A. The roll paper holder 8 can therefore pivot while holding the left side panel 21 separated from the right side panel 25.

When the roll paper compartment 6 causes the roll paper holder 8 to pivot with the access cover 4 to the front of the printer, the left side panel 21 moves away from the right side panel 25, and when the access cover 4 is in the open position 4B, the left side panel 21 is at the position (second position) separated farthest from the right side panel 25. In addition, when the roll paper holder 8 pivots with the access cover 4 in the opposite direction, the left side panel 21 approaches the right side panel 25, and when the access cover 4 is in the closed position 4A, the left side panel 21 is at the position (first position) closest to the right side panel 25. As a result, side pressure can be applied to the roll paper 7 when the access cover 4 is closed, and when the access cover 4 is opened, the side pressure can be released and the width of the opening for dropping the roll paper into the roll paper compartment 6 is increased.

Figure 7:
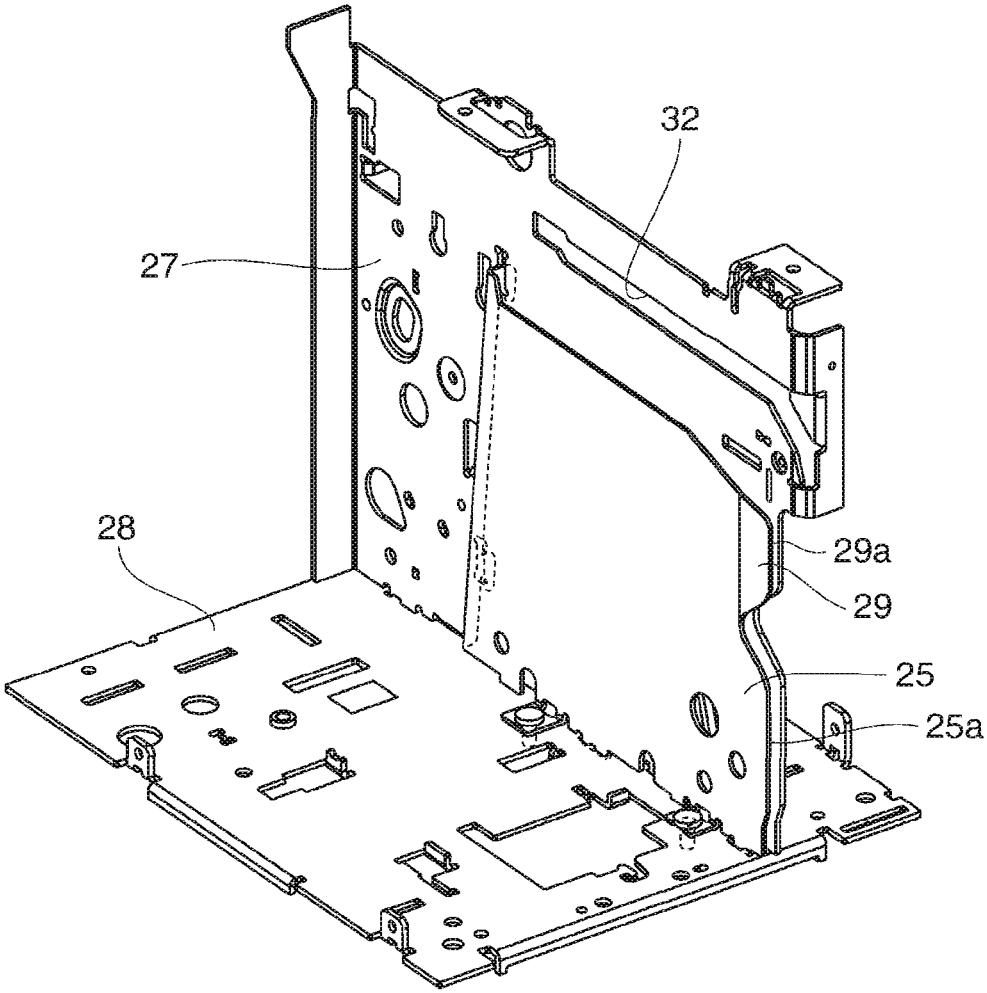
FIG. 7 is an oblique view from the left front side of part of the printer frame and the right side panel of the roll paper compartment.

FIG. 7 is an oblique view from the front left side of part of the main printer frame and the right side panel of the roll paper compartment. The main printer frame that supports the internal mechanisms of the roll paper printer 1 is made of sheet metal, and includes a right frame panel 27 disposed on the right side of the roll paper compartment 6. The right frame panel 27 is attached to the bottom 28 of the main printer frame to which the support bracket 24 is affixed. The right side panel 25 of the roll paper compartment 6 is disposed aligned with the front end of the right frame panel 27, and is fastened to the right frame panel 27 by hooks at two vertically separated locations at the back end of the right side panel 25. The bottom of the right side panel 25 is fastened to the bottom 28 by screws at two locations separated in the front-back direction of the printer.

Because the linkage members of the right platen support mechanism 19A described above are disposed between the right side panel 25 and the right frame panel 27, the right side panel 25 is attached to leave a specific gap between the right side panel 25 and the right frame panel 27. The top of the front end 25*a* (the end facing the opening) of the right side panel 25 is recessed toward the back of the printer, and a basically trapezoidal roll paper guide tab 29 is formed protruding diagonally to the front right side of the printer. More specifically, the roll paper guide tab 29 is shaped so that the distance between it and the left side panel 21 increases with proximity to the distal end of the roll paper guide tab 29. In other words, the top of the front end of the right side panel 25 is bent to the outside (toward the right frame panel 27), and functions as the roll paper guide tab 29. The roll paper guide tab 29 protrudes diagonally to the front right side of the printer without touching the right frame panel 27.

Roll Paper Guide Structure Using the Side Panels

Figure 8:
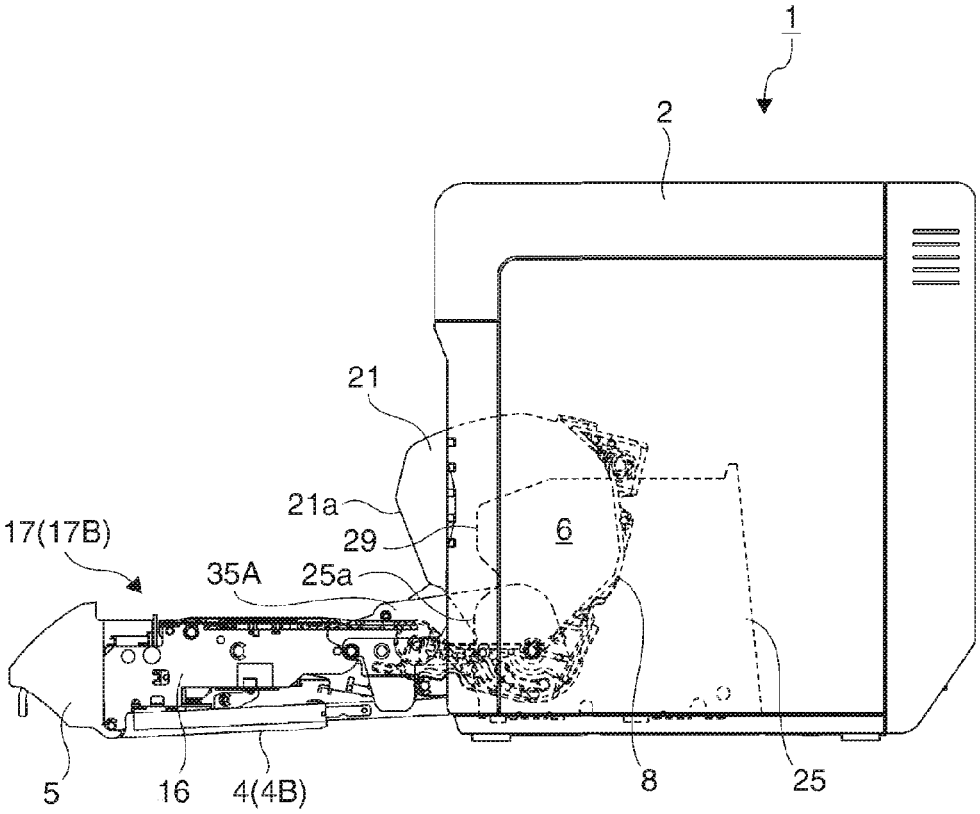
FIG. 8 describes the relative positions of the left side panel and right side panel of the roll paper holder when seen from the side of the printer.

FIG. 8 shows the relative positions of the left and right side panels of the roll paper holder. When the access cover 4 is opened as far as possible as shown in the figure, the front edge 21*a* of the left side panel 21 protrudes greatly through the opening 3 to the front of the printer case 2. As a result, when loading roll paper into the roll paper compartment 6, the roll paper 7 can be quite easily positioned to the left side panel 21 on the outside of the printer case 2, and the roll paper 7 can be dropped in along the left side panel 21. Roll paper 7 can therefore be easily loaded between the left side panel 21 and right side panel 25 even if the gap between the left side panel 21 and right side panel 25 is narrow.

In addition, because the right side panel 25 is stationary, all of the front end 25*a* including the roll paper guide tab 29 is positioned behind the front of the printer case 2. The roll paper 7 therefore cannot be positioned to the right side panel 25 on the outside of the printer case. However, because the front end of the roll paper guide tab 29 extends diagonally to the right front, roll paper 7 that is dropped in to a position passed the right side of the main part of the right side panel 25 can be guided by the roll paper guide tab 29 to the left side of the right side panel 25. Collision of the roll paper 7 being loaded with the front end of the right side panel 25 can therefore be suppressed, and the roll paper 7 can be dropped between the right side panel 25 and left side panel 21 even when the position where the roll paper 7 is dropped in is slightly offset. More specifically, the actual width of the opening for loading roll paper can be increased by providing this roll paper guide tab 29. As a result, dropping roll paper 7 into the roll paper compartment is not made difficult when the gap between the right side panel 25 and left side panel 21 is substantially the same as the width of the roll paper 7 along the rotational axis thereof, and roll paper can be easily loaded.

Platen Support Mechanism

A support shaft (not shown in the figure) extending widthwise to the printer is disposed at a position on the back end of the platen unit 17. As shown in FIG. 7, a guide channel 32 that extends from the front towards the back of the printer is formed with a specific width in the right frame panel 27. The right platen support mechanism 19A described above has a guide mechanism rendered by inserting the ends of the support shaft disposed to the back end of the platen unit 17 so that they can slide in this guide channel 32. The platen unit 17 is guided by this guide mechanism from the closed position 17A along a horizontal path to an intermediate position partway to the open position 17B. The right platen support mechanism 19A also has a six joint linkage mechanism 31 that holds the platen unit 17 guided by this guide mechanism in a specific posture, and causes the platen unit 17 to move along a curved path from this intermediate position to the open position 17B while continuing to hold the platen unit 17 in the same posture.

The six-joint linkage mechanism 31 is described next with reference to FIG. 3 to FIG. 5.

The six-joint linkage mechanism 31 has a first compound link 34 and a second compound link 35. The first compound link 34 includes a first link 34A and a second link 34B connected in series at a first pin joint 34C. The second compound link 35 includes a third link 35A (link member) and a fourth link 35B connected in series at a second pin joint 35C. The connections of the links in the first compound link 34 are shown schematically in FIG. 3 to FIG. 5 by the imaginary line C. The connections of the links in the second compound link 35 are shown schematically by the imaginary line D. A fifth link (not shown in the figure) spans between the first pin joint 34C of the first compound link 34 and the second pin joint 35C of the second compound link 35. This fifth link is shown schematically by imaginary line E in FIG. 3 to FIG. 5.

The second compound link 35 is located towards the back of the printer relative to the first compound link 34. More specifically, the bottom end of the first compound link 34 and the bottom end of the second compound link 35 are connected to a third pin joint 34D and a fourth pin joint 35D, respectively, at positions separated a specific distance in the front-back direction of the printer. Likewise, the top end of the first compound link 34 and the top end of the second compound link 35 are respectively connected by a fifth pin joint 34E and a sixth pin joint 35E to positions on the side of the platen unit 17 separated a specific distance in the front-back direction of the printer. The six-joint linkage mechanism 31 is thus rendered by these first to fifth links and first to sixth pin joints.

When the platen unit 17 is in the closed position 17A and the access cover 4 is in the closed position 4A, the first compound link 34 and second compound link 35 of the six-joint linkage mechanism 31 are folded together with the first pin joint 34C and second pin joint 35C where the links are connected projecting toward the front of the printer (see imaginary lines C and D in FIG. 3). While the platen unit 17 slides to the front guided by the guide channel 32, that is, while the height of the sixth pin joint 35E of the six-joint linkage mechanism 31 is determined by the guide channel 32, the platen unit 17 slides forward while held in a constant posture. When the sixth pin joint 35E separates from the guide channel 32, the front and back compound links 34 and 35 move from the folded position to a substantially straight extended position, and the access cover 4 drops to an intermediate position between the closed position 4A and the open position 4B.

After the compound links 34 and 35 are fully extended, the six-joint linkage mechanism 31 functions as a four-joint parallel linkage mechanism (see imaginary lines C and D in FIG. 4 and FIG. 5). As a result, the platen unit 17 is thereafter held in the same posture while moving along a curved path to the open position 17B. The access cover 4 also drops from the intermediate position to the open position 4B. Note that FIG. 4 shows when movement starts along the curved path after the compound links 34 and 35 are extended substantially straight.

The six-joint linkage mechanism 31 has a holding mechanism (not shown in the figure) for holding the first link 34A and second link 34B of the first compound link 34 in the substantially straight, fully extended position. Various configurations can be used as this holding mechanism, including a configuration that prevents the two links in the compound link from rotating to the opposite side after extending to the substantially straight position, a configuration that urges the pin joints connecting the two links toward the back of the printer by means of a tension springs or other means, a configuration that limits the path of motion of the pin joints connecting the links by means of a guide channel and guide pin, or other configuration.

Guiding the Roll Paper by Means of Side Panels and Linkage Mechanism

Figure 9:
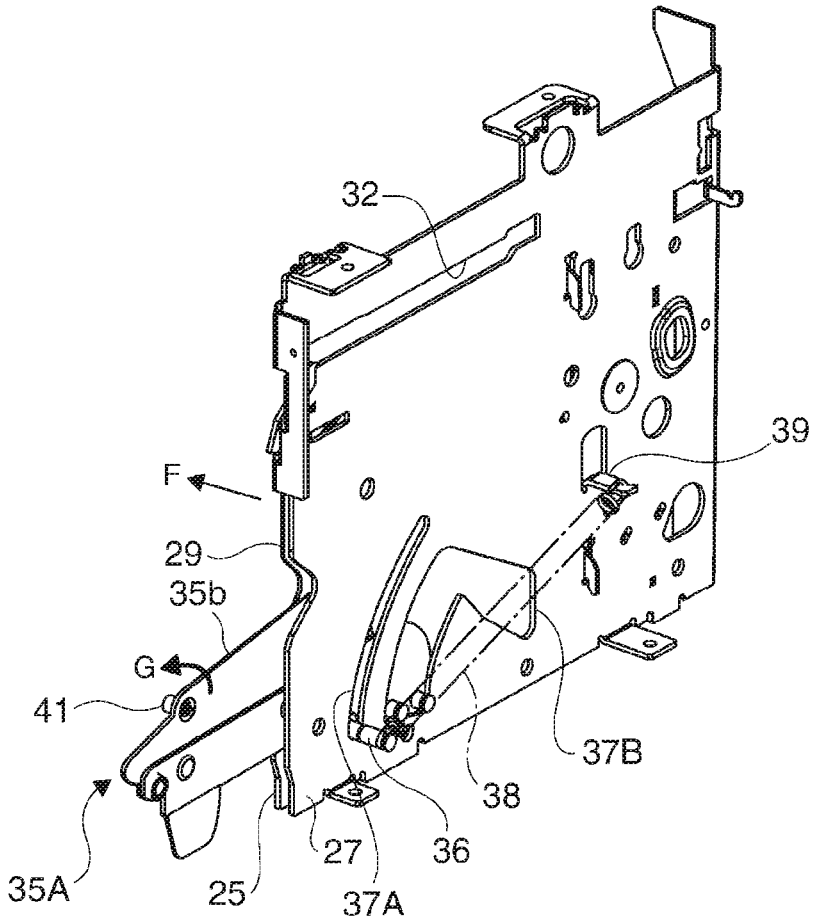
FIG. 9 is an oblique view from the right front side of right frame panel, left side panel, and the third link of the six joint linkage mechanism.
Figure 10:
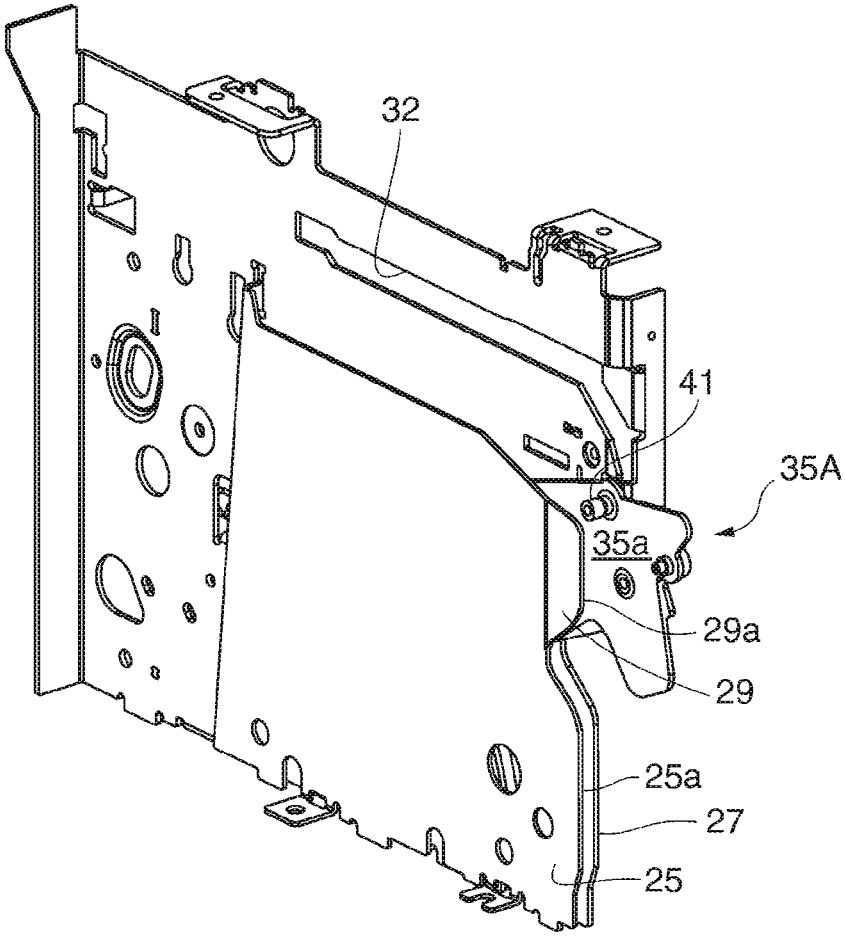
FIG. 10 is an oblique view from the left front side of right frame panel, right side panel, and the third link of the six joint linkage mechanism.

FIG. 9 is an oblique view from the right front side and FIG. 10 is an oblique view from the left front side of the right frame panel, right side panel, and third link of the six joint linkage mechanism. The third link 35A is the link on the side where the second compound link 35 is connected to the platen unit 17. As shown in FIG. 9 and FIG. 10, the third link 35A is located in the space between the right frame panel 27 and right side panel 25. In the position shown in FIG. 5, that is, when the platen unit 17 is in the open position 17B and the access cover 4 is in the open position 4B, the third link 35A is maximally extended to the front of the printer as shown in FIG. 9. At this time the top part of the third link 35A protrudes greatly to the front of the printer from the space between the right frame panel 27 and right side panel 25. FIG. 10 shows when the access cover 4 is partially closed and the platen unit 17 is partially raised along the curved path of movement. At this time the top of the third link 35A is raised to a position overlapping the roll paper guide tab 29 part of the right side panel 25.

As described above, because the roll paper guide tab 29 extends diagonally to the front right side of the printer, the path of the third link 35A moving rotationally in the space between the right frame panel 27 and right side panel 25 interferes with the roll paper guide tab 29. However, because the right side panel 25 is attached only at the bottom and back ends thereof, the top part of the front end 25*a* of the right side panel 25 where the roll paper guide tab 29 is formed is a free end that can move transversely, that is, toward and away from the left side panel 21, by means of deflection of the right side panel 25. Therefore, when the third link 35A passes the position overlapping the roll paper guide tab 29, the roll paper guide tab 29 can be escaped toward the left side panel 21 (in the direction of arrow F in FIG. 9) by deflection of the right side panel 25. As a result, the roll paper guide tab 29 does not obstruct rotational movement of the third link 35A.

When the third link 35A moves away from the position overlapping the roll paper guide tab 29, deflection of the right side panel 25 ends and the roll paper guide tab 29 returns to its original position. In this embodiment of the invention, the position where the roll paper guide tab 29 is formed on the front end 25*a* of the right side panel 25 is set to a position not overlapping the third link 35A when the access cover 4 is open. As a result, when the roll paper 7 is dropped in, the roll paper guide tab 29 is not moved by interference with the third link 35A in the direction narrowing the size of the drop-in opening.

When the right side panel 25 is deflected by the third link 35A passing the position overlapping the roll paper guide tab 29, the right side panel 25 moves toward the left side panel 21 a distance corresponding to the amount of deflection. When the third link 35A is in this rotated position, the side pressure applied by the left side panel 21 is released by the side pressure release cam 26 described above. In this embodiment of the invention, the leftward movement of the left side panel 21 when side pressure is released by the side pressure release cam 26 (the distance between the first position and second position described above) is equal to the protrusion width L1 of the flat surface 26*b* shown in FIG. 6. The leftward movement of the right side panel 25 resulting from deflection is at most equal to the distance t (see FIG. 11) that the distal end 29*a* of the roll paper guide tab 29 extends to the right. In this embodiment of the invention, therefore, these dimensions are set so that L1≥t. When thus configured, the distance between the left side panel 21 and right side panel 25 does not become smaller during the roll paper loading operation than the distance between the left side panel 21 and the right side panel 25 when the access cover 4 is closed. As a result, problems such as members becoming unable to move and loading the roll paper being disabled as a result of interference with the roll paper 7 while the roll paper is being loaded are prevented.

When the access cover 4 is opened, the top of the third link 35A protrudes greatly forward from the front of the printer case 2 as shown in FIG. 8. As a result, if the right end of the roll paper 7 is positioned against the left side 35*a* (roll guide surface) of the third link 35A, the roll paper 7 can be guided straight along the left side 35*a*, which extends straight toward the right side panel 25, and moved to the front end 25*a* of the right side panel 25. At this time the left side 35*a* can also guide the roll paper 7 so that the roll paper 7 does not become angled to the loading direction. As the roll paper 7 then moves guided by the left side 35*a*, the left end of the roll paper 7 can then be positioned to the left side panel 21 described above.

Figure 11:
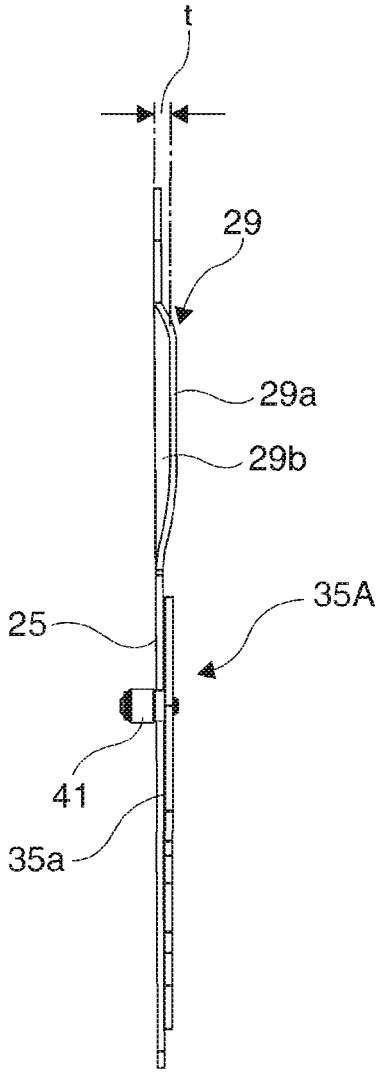
FIG. 11 is a front view of the third link and the right side panel from the front of the printer.

FIG. 11 is a front view of the third link and right side panel from the front of the printer when the access cover 4 is in the open position 4B. As shown in the figure, the third link 35A is attached so that it contacts the right side panel 25 from the right side. The roll paper guide tab 29 extends so that the distal end 29*a* in the protrusion direction is positioned on the right side of the left side 35*a* of the third link 35A. With this configuration the roll paper 7 that is guided along the left side 35*a* as it is loaded does not collide with the end of the roll paper guide tab 29 and is pushed into position by the roll paper guide tab 29. As a result, the roll paper 7 drops along the left side of the right side panel 25 guided by the roll paper guide tab 29.

In order for the roll paper 7 being loaded to be reliably pushed into position by the roll paper guide tab 29, the distal end 29*a* of the roll paper guide tab 29 only needs to protrude at least the thickness of the right side panel 25 (dimension t in FIG. 11) to the right from the base of the roll paper guide tab 29, that is, from the position where it joins the main part of the right side panel 25. With these dimensions, if at least the top edge 35*b* of the left side 35*a* of the third link 35A is touching the right side panel 25, the roll paper 7 guided along the left side 35*a* will reliably contact the left side 29*b* of the roll paper guide tab 29 and not the end of the roll paper guide tab 29, and the roll paper 7 will be moved to the side by the roll paper guide tab 29. As a result, the roll paper 7 can be reliably dropped in on the left side of the right side panel 25.

In this embodiment of the invention the urging force in the direction causing the top edge 35*b* of the left side 35*a* of the third link 35A to contact the right side panel 25 is applied to the third link 35A. More specifically, as shown in FIG. 9, a guide channel 37A for guiding a guide pin 36 disposed to the second pin joint 35C of the third link 35A along a curved path is formed in the right frame panel 27, and a hook 39 for holding one end of a tension spring 38 (urging member) is disposed at a position toward the back of the printer from the guide channel 37A. The other end of the tension spring 38 is connected to the distal end of the guide pin 36.

Because the hook 39 is positioned higher than the position of the third link 35A when in the extended position shown in FIG. 9, the urging force of the tension spring 38 operates as torque causing the third link 35A to rotate in the direction of arrow G in FIG. 9. The urging force of the tension spring 38 therefore causes the top edge 35*b* of the left side 35*a* of the third link 35A to contact the right side panel 25.

Note that the guide channel 37A and guide channel 37B disposed behind guide channel 37A can be used to render the holding mechanism described above that holds the first link 34A and second link 34B substantially straight when fully extended.

Figure 12:
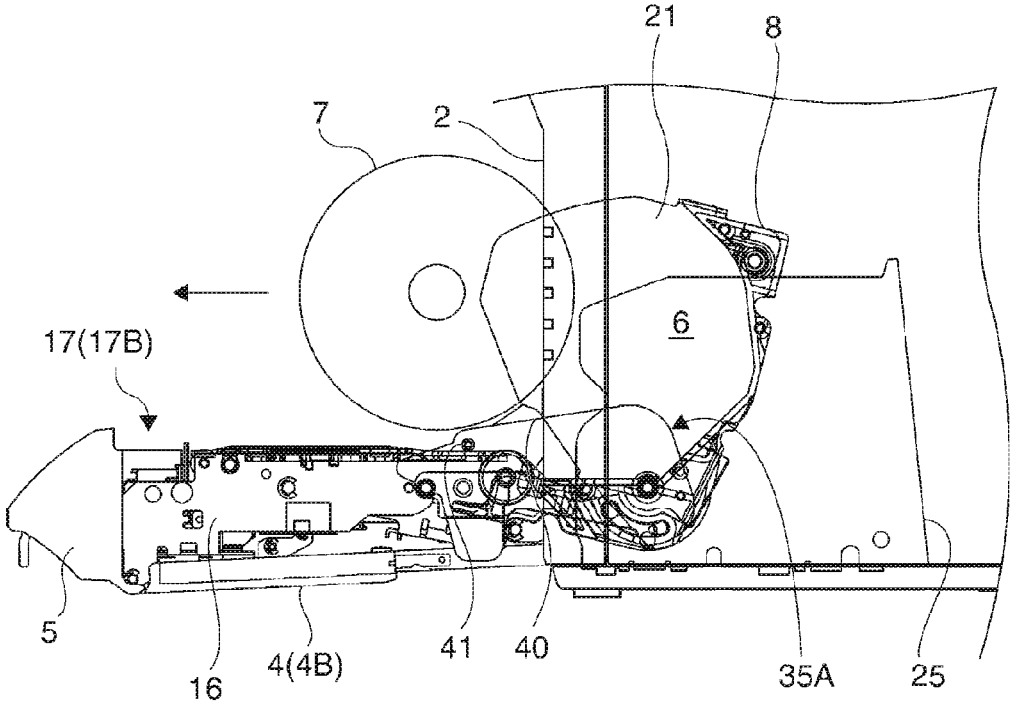
FIG. 12 describes loading roll paper.

Loading the roll paper into the roll paper compartment is described next with reference to FIG. 12 and FIG. 13. As shown in FIG. 12, when the access cover 4 is open, the top edge 35*b* of the third link 35A is an inclined surface 40 (inclined guide surface) that descends straight toward the front of the printer. Therefore, when positioning the roll paper 7 to the left side 35*a* of the third link 35A fails and the roll paper 7 is dropped in from the right side of the left side 35*a*, the roll paper 7 rests on the inclined surface 40 of the third link 35A. The roll paper 7 is therefore guided along the inclined surface 40 and rolls toward the front of the printer, and does not drop in toward the back of the roll paper compartment 6 from an undesirable loading position widthwise to the printer. The roll paper 7 therefore does not stop against the front end of the right side panel 25 at a position unsuitable as an entrance to the roll paper compartment 6. The roll paper 7 can therefore be quickly reloaded.

As shown in FIG. 9 and FIG. 10, a guide boss 41 that extends toward the side of the left side panel 21 is formed on the distal end part of the third link 35A that extends toward the side of the platen unit 17. This guide boss 41 is formed on the left side 35*a* of the third link 35A, and is located below the front end of the inclined surface 40 described above when the access cover 4 is open as shown in FIG. 12 and FIG. 13. Note that the guide boss 41 can be formed at an appropriate position between the front and back ends of the inclined surface 40.

If the roll paper 7 is successfully positioned on the left side of the left side 35*a* of the third link 35A and the roll paper 7 is dropped in from a position toward the back of the printer from the guide boss 41, the roll paper 7 falls onto the front of the bottom 20 of the roll paper holder 8, which is sloped steeply toward the inside of the roll paper compartment 6, and not onto the substantially horizontal surface contiguous to the platen 11. As a result, the roll paper 7 falls quickly to the inside of the roll paper compartment 6 without stopping at a position unsuitable as an entrance to the roll paper compartment 6.

Figure 13:
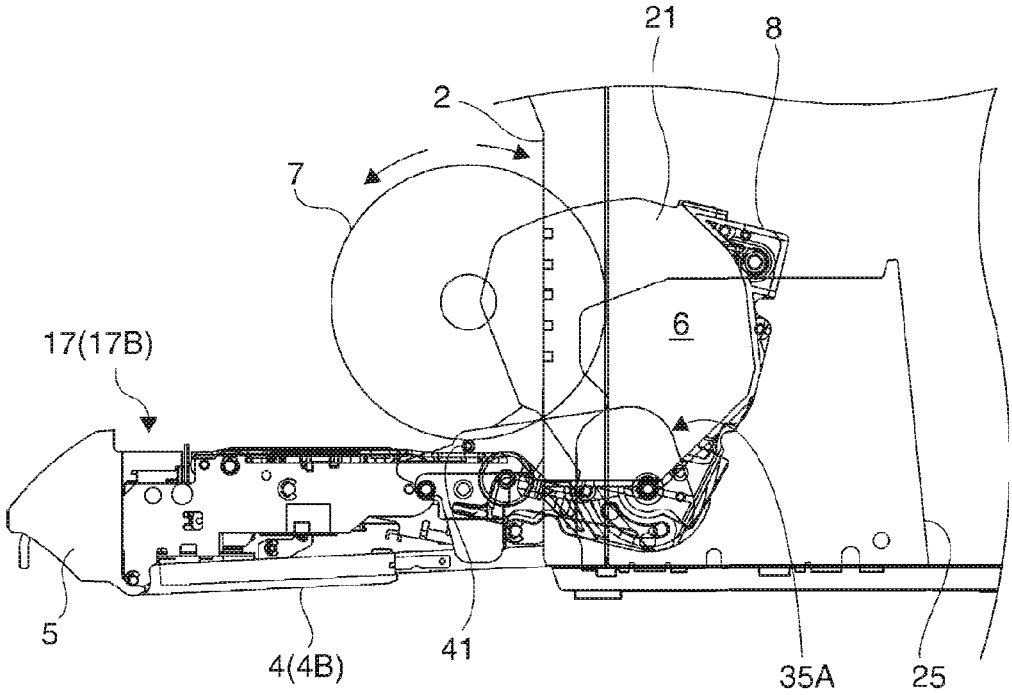
FIG. 13 describes loading roll paper.

However, if as shown in FIG. 13 the roll paper 7 is dropped from a position directly above the guide boss 41, the roll paper 7 cannot stop in a stable position on top of the guide boss 41 and therefore either rolls into the roll paper compartment 6 or rolls toward the front of the printer and falls onto the substantially flat platen 11. In either case, however, the roll paper 7 does not stop at a position unsuitable as an entrance to the roll paper compartment 6. The loading operation can therefore either completed or redone quickly, and the roll paper can therefore be loaded quickly.

Other Embodiments (1) A platen support mechanism 19 (19A, 19B) including a guide mechanism that guides the platen unit 17 along a guide channel 32, and a six joint linkage mechanism that guides that guides the platen unit 17 along a curved path after moving along this guide channel 32, is used as a mechanism for opening and closing the access cover 4 and platen unit 17 in the foregoing embodiment, but a configuration using a four joint parallel linkage mechanism can be used instead. In this case, a link of the four joint parallel linkage mechanism can be configured identically to the third link 35A described above to achieve the same operation and effect.

(2) The embodiment described above describes applying the invention to a roll paper printer 1 that prints with an inkjet head, but the invention can be applied to other types of printers in which roll paper is loaded for printing. For example, the invention can also be applied to thermal printers, laser printers, and facsimile machines.

(3) A roll paper guide tab 29 is rendered only on the right side panel 25 in the embodiment described above, but an identically configured roll paper guide tab may also be formed on the left side panel 21.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A roll paper loading mechanism comprising:

a linkage mechanism that supports an access cover for opening and closing a roll paper loading opening formed in a device case so that the access cover can pivot on one end and move between a closed position where the opening is closed and an open position to which the other end swings away from the opening;

a roll paper loading unit formed so that when the access cover is open the roll paper can be dropped in from the opening side with the axis of rotation of the roll paper transverse;

wherein the roll paper loading unit includes two side panels disposed to hold the roll paper therebetween in the direction of the axis of rotation when the access cover is closed, wherein one of the two side panels is a movable side panel that can pivot through the opening to a position where at least part of the side panel is exposed outside the device case when the access cover is opened, and the other of the two side panels is a stationary side panel fixed inside the device case; and a roll paper guide tab formed on the end part of the stationary side panel on the opening side and extending away from the movable side panel such that the distance between the roll paper guide tab and the moveable side panel increases with proximity to a distal end of the roll paper guide tab.

2. The roll paper loading mechanism described in claim 1, wherein:

the stationary side panel is affixed so that the end part where the roll paper guide tab is formed is a free end that can move toward and away from the movable side panel.

3. The roll paper loading mechanism described in claim 2, wherein:

the linkage mechanism includes a link member disposed along the opposite side of the stationary side panel as the movable side panel;

the link member is configured to descend in the direction in which the access cover pivots when the access cover opens, and overlap the end part of the stationary side panel on the open side; and the roll paper guide tab is formed on a part of the stationary side panel separated from the overlap position.

4. The roll paper loading mechanism described in claim 3, wherein:

the part of the roll paper guide tab protruding farthest to the side of the opening is positioned at least the thickness of the stationary side panel from the main part of the stationary side panel in the direction away from the movable side panel.

5. The roll paper loading mechanism described in claim 4, further comprising:

an urging member that urges the link member to the side of the stationary side panel so that the link member and the stationary side panel touch.

6. The roll paper loading mechanism described in claim 5, further comprising:

a tapered side pressure release cam, coupled to the stationary side panel, configured such that when the movable side panel pivots through an opening to a position where the access cover is opened, the link member is in contact with the tapered side pressure release cam and gradually moves away from the urging member.

7. The roll paper loading mechanism described in claim 3, wherein:

the part of the stationary side panel where the roll paper guide tab is formed deflects in the direction toward the movable side panel due to interference between the roll paper guide tab and the link member when the access cover opens and closes;

the movable side panel moves between a first position and a second position on the stationary side panel side of the first position in conjunction with the access cover opening and closing, moves to the first position when the access cover is in the open position, and moves to the second position when the access cover is in the closed position; and the distance between the first position and the second position is greater than the deflection of the stationary side panel toward the movable side panel caused by interference between the roll paper guide tab and the link member.

8. The roll paper loading mechanism described in claim 3, wherein:

the link member has a roll guide surface that is opposite the movable side panel and extends straight toward the stationary side panel, and is formed on a part of the stationary side panel that protrudes from an end part on the open side toward the access cover in the open position.

9. The roll paper loading mechanism described in claim 8, wherein:

a guide boss that protrudes from the roll guide surface toward the movable side panel is disposed to the link member at an intermediate position in the guiding direction of the roll guide surface.

10. The roll paper loading mechanism described in claim 3, wherein:

the opening is formed in the front of the device case;

the link member moves to the front of the device case and protrudes from the front end of the stationary side panel to the front of the device case when the access cover is opened; and the top of the protruding link member is an inclined guide surface that slopes down toward the front of the device case.

11. A printing device comprising:

a device case that houses a print mechanism;

an opening formed in the device case for loading roll paper;

an access cover for opening and closing the opening; and the roll paper loading mechanism described in claim 1.

* * * * *